US007419283B2

(12) United States Patent
Von Rönn et al.

(10) Patent No.: US 7,419,283 B2
(45) Date of Patent: Sep. 2, 2008

(54) ELECTRICAL DECORATION LIGHTING DEVICE AND SET OF SUCH DEVICES

(75) Inventors: Thomas Von Rönn, Hamburg (DE); Birgit Clemens, Hamburg (DE); Harald Rathman, Bergholer (DE)

(73) Assignee: RCR GmbH & Co. KG Gesellschaft Fuer Produktentwicklung, Hamburg (DE)

( * ) Notice: Subject to any disclaimer, the term of this patent is extended or adjusted under 35 U.S.C. 154(b) by 286 days.

(21) Appl. No.: 11/339,706

(22) Filed: Jan. 24, 2006

(65) Prior Publication Data

US 2006/0198164 A1 Sep. 7, 2006

Related U.S. Application Data

(63) Continuation-in-part of application No. 10/993,650, filed on Nov. 19, 2004.

(30) Foreign Application Priority Data

| | | |
|---|---|---|
| Sep. 2, 2004 | (DE) | 20 2004 013 829 U |
| Feb. 23, 2005 | (DE) | 10 2005 008 559 |
| Apr. 15, 2005 | (EP) | 05090105 |

(51) Int. Cl.
*F21L 4/04* (2006.01)
*F21V 21/20* (2006.01)

(52) U.S. Cl. ..... 362/401; 362/198; 362/191; 362/194; 362/234

(58) Field of Classification Search ..... 362/401, 362/123, 194, 191, 198, 199, 195, 227, 234, 362/249, 251, 252, 243, 396, 391, 384, 403, 362/38

See application file for complete search history.

(56) References Cited

U.S. PATENT DOCUMENTS

| | | | | |
|---|---|---|---|---|
| 4,866,580 | A | 9/1989 | Blackerby | 362/205 |
| 4,926,062 | A | 5/1990 | Ussery et al. | 307/116 |
| 4,947,291 | A | 8/1990 | McDermott | 362/19 |
| 5,154,600 | A | 10/1992 | Sylvestre | 431/253 |
| 5,226,709 | A | 7/1993 | Labranche | 362/568 |

(Continued)

FOREIGN PATENT DOCUMENTS

| | | |
|---|---|---|
| DE | 16 15 957 U | 11/1950 |

(Continued)

*Primary Examiner*—Bao Q Truong
(74) *Attorney, Agent, or Firm*—Kenyon & Kenyon LLP

(57) ABSTRACT

A set that includes a plurality of the lighting devices, each lighting device including a body having a light-emitting element, an attachment element for attaching the lighting device to a supporting body, and an independent power source for supplying power to the light-emitting element. The set also includes a wireless transmitting device configured to turn on and off the light-emitting elements of each one of the plurality of lighting devices. The wireless transmitting device may be integrated in one of the plurality of lighting devices. The wireless transmitting device may be disposed in a remote control unit that is separate from each one of the plurality of lighting devices.

15 Claims, 7 Drawing Sheets

U.S. PATENT DOCUMENTS

| | | | | |
|---|---|---|---|---|
| 5,329,437 | A | 7/1994 | Briggs | 362/393 |
| 5,412,284 | A | 5/1995 | Moore et al. | 315/155 |
| 5,424,925 | A | 6/1995 | Jenke et al. | 362/123 |
| 5,653,530 | A | 8/1997 | Pittman | 362/307 |
| 5,788,361 | A | 8/1998 | Lee | 362/249 |
| 5,829,869 | A | 11/1998 | Clegg et al. | 362/392 |
| 5,939,835 | A | 8/1999 | Takeda et al. | 315/289 R |
| 5,988,241 | A | 11/1999 | Bosten et al. | 144/154.5 |
| 6,060,838 | A | 5/2000 | Cantoni et al. | 315/159 |
| 6,066,924 | A | 5/2000 | Lederer | 315/185 R |
| 6,210,022 | B1 | 4/2001 | Howard | 362/235 |
| 6,244,725 | B1 | 6/2001 | Gary et al. | 362/234 |
| 6,257,743 | B1 | 7/2001 | Ursch | 362/418 |
| 6,341,875 | B1 | 1/2002 | Chu | 362/252 |
| 6,352,355 | B1 | 3/2002 | Law | 362/253 |
| 6,439,750 | B2 | 8/2002 | Klaus et al. | 362/418 |
| 6,443,604 | B1 | 9/2002 | Rodenberg | 362/488 |
| 6,478,448 | B1 | 11/2002 | Gary et al. | 362/254 |
| 6,561,603 | B2 | 5/2003 | Knab et al. | 362/265.4 |
| 6,629,767 | B2 | 10/2003 | Osiecki et al. | 362/202 |
| 6,794,825 | B1 | 9/2004 | Kao | 315/185 R |
| 2001/0030862 | A1 | 10/2001 | Simms | 362/123 |
| 2003/0035291 | A1 | 2/2003 | Jensen et al. | 362/392 |
| 2003/0081420 | A1 | 5/2003 | Jensen et al. | 362/351 |

FOREIGN PATENT DOCUMENTS

| | | | |
|---|---|---|---|
| DE | 69 16 389 | U | 4/1969 |
| DE | 74 01 918 | U1 | 9/1974 |
| DE | 37 35 217 | A | 4/1989 |
| DE | 89 00 563 | U | 11/1989 |
| DE | 41 13 442 | A1 | 10/1992 |
| DE | 296 02 482 | U1 | 5/1996 |
| DE | 196 20 876 | A1 | 11/1997 |
| DE | 198 14 231 | A1 | 10/1999 |
| DE | 200 03 164 | U1 | 7/2000 |
| DE | 199 62 100 | A1 | 7/2001 |
| DE | 200 20 560 | A1 | 9/2001 |
| DE | 100 17 913 | A1 | 10/2001 |
| DE | 201 14 003 | U1 | 1/2002 |
| DE | 201 00 891 | U1 | 6/2002 |
| DE | 102 06 418 | A1 | 8/2003 |
| DE | 103 02 593 | A1 | 7/2004 |
| GB | 24747 | | 4/1912 |
| JP | 2001-1 18401 | A | 4/2001 |

ELECTRICAL DECORATION LIGHTING DEVICE AND SET OF SUCH DEVICES

CROSS-REFERENCE TO RELATED APPLICATIONS

This application claims the benefit of foreign priority under 35 U.S.C. §119 of German Patent Application No. 202004 013 829.8, filed on Sep. 2, 2004, German Patent Application No. 102005 008 559.8, filed on Feb. 23, 2005, and European Patent Application No. 05050105.7, filed on Apr. 15, 2005, each of which is expressly incorporated herein by reference in its entirety. In addition, this application is a continuation-in-part of U.S. patent application Ser. No. 10/993,650, which was filed on Nov. 19, 2004, which is expressly incorporated herein in its entirety by reference thereto.

FIELD OF THE INVENTION

The present invention relates to an electrical decoration lighting device and to a set of such lighting devices.

BACKGROUND

Lighting devices are commonly used for decorative lighting, particularly for festive occasions. One such application is decorative lighting on a Christmas tree. Further applications are atmospheric lighting for celebrations or in the form of motif lighting for special holidays, semi-transparent decoration housings, for example, being slipped onto the lighting body so that they are illuminated from inside.

Lighting devices independent of an electrical network are known. For example, such lighting devices are described in German Patent No. 200 03 164 U1, German Patent No. 201 00 891 U1, German Patent No. 201 14 003 U1, German Patent No. 20 2004 000 124 U1, German Patent No. 200 20 560 A1, German Patent No. 41 13 442 A1, German Patent No. 198 14 231 A1, German Patent No. 102 06 418 A1 and German Patent No. 103 02 593 A1. Conventional household batteries or storage batteries, which are situated in the lighting body, are typically used as electrical energy storage/current source elements. Because of the weight of these electrical energy storage/current source elements, problems occur with respect to the stability of the lighting devices, particularly when attached to a supporting body, e.g. to a branch of a Christmas tree.

U.S. Patent Publication No. 2003/0081420 A1 describes a lighting device having a candle-shaped lighting part and a battery housing that is rigidly joined to the lighting part by a socket part. At the lower end of the lighting device, below the battery housing, an attachment element is provided for attaching the lighting device to a wall. The battery housing is integrated into the lighting base.

German Patent No. 69 16 389 U describes a lighting device having a hook-shaped holding device for hooking onto a limb of a Christmas tree, and having a battery chamber at the lower end of the lighting device. The lighting device is switched on and off by a built-in, mechanical switch.

Also, German Patent Nos. 89 00 563 U and 37 35 217 A describe lighting devices having a separate Christmas-tree glitter ball, on whose surface solar cells are provided for charging storage batteries located within the lighting body.

There is a need for a lighting device that exhibits improved stability when attached to a supporting body.

Also, there is a need for a lighting device set which can be operated simply and with little expenditure.

SUMMARY OF THE INVENTION

The present invention, according to various example embodiments thereof, relates to a set that includes a plurality of lighting devices. Each lighting device includes a body having a light-emitting element, an attachment element for attaching the lighting device to a supporting body, and an independent power source for supplying power to the light-emitting element. In addition, the set includes a wireless transmitting device configured to turn on and off the light-emitting elements of each one of the plurality of lighting devices.

The wireless transmitting device may be integrated in one of the plurality of lighting devices. Alternatively, the wireless transmitting device may be disposed in a remote control unit that is separate from each one of the plurality of lighting devices. Each one of the plurality of lighting devices may include a switching element that is actuatable for switching the light-emitting element on and off. Each one of the plurality of lighting devices may have a receiver configured to operate its respective switching element, or at least one of the plurality of lighting devices may have a receiver configured to operate its respective switching element.

Each one of the plurality of lighting devices may include a housing that is disposed spatially apart from the lighting body. The housing may be connected to the lighting body by a connecting element. The attachment element may be arranged one of the lighting body and the connecting element. The housing may accommodate at least a part of the current source. The housing may be suspended below the lighting body. For instance, the center of gravity of the housing may be situated below an attachment position defined by the attachment element. The attachment element may be formed by the connecting element.

In an example embodiment, at least one of the lighting devices is configured as a Christmas tree ornament, and the supporting body is a branch of a Christmas tree. Also, at least one of the lighting devices may be configured as a Christmas tree topper, and the supporting body is a branch of a Christmas tree.

The present invention, according to an example embodiment thereof, provides a lighting device in which a power source, e.g., an electrical energy storage/current source element, is arranged at a spatial distance from the lighting body. The weight of the lighting body may be reduced accordingly, thereby increasing the stability of the lighting body when fastened to a supporting body, e.g., the branch of a Christmas tree.

A housing, according to one embodiment, is configured for arrangement suspended below the lighting body, e.g., to provide a lower center of gravity of the entire device. Preferably the housing is arranged below an attachment element located at an attachment point. In this manner, the stability of the lighting device is increased, and improved alignment of the lighting body, e.g. in the upright operating position, is attained. In an example embodiment, the attachment element may preferably allow the lighting device to swivel upon deflection out of the operating position. In this embodiment, it is preferable that the lighting device experiences a restoring force into the operating position. In an example embodiment, the housing is disposed at least partially or completely below the attachment point of the lighting device to the supporting body, and/or the center of gravity of the housing being situated below the attachment point of the lighting device to the supporting body.

The lighting device may include a connecting element that is flexible, e.g., flexible plastic, a wire element, etc. This permits adaptation to different spatial conditions, especially with respect to the arrangement of the housing for the a power source, e.g., an electrical energy storage/current source element, as well as an adjustment of the center-of-gravity position. A flexible connecting element may also be used as an attachment element by bending it into a suitable shape. It is then possible to dispense with an additional attachment element, which may simplify the overall design. A particularly simple form of attachment is the winding or looping of a flexible connecting element about the supporting body, e.g. a branch of a Christmas tree. For this purpose, the connecting element preferably has a length in the range of 2 to 20 cm, more preferably in the range of 5 to 15 cm. A further embodiment of the present invention includes an arrangement that provides a clamping connection by suitable bending of the connecting element. The attachment element may be preformed by bending the connecting element during manufacture, in order to increase convenience for the user of the lighting device, and to avoid incorrect attachment.

The attachment element is preferably disposed either on the lighting body or on the connecting element, and is preferably a spatial distance away from the housing for the power source, e.g., an electrical energy storage/current source element, and/or the housing that accommodates a part of the power source, e.g., an electrical energy storage/current source element. By arranging the housing on a different side of the attachment point relative to the lighting body, there may be provided a reduction of the weight situated above the attachment point, thereby increasing the stability of the lighting device. In an example embodiment, separate attachment elements may be provided for the lighting body and for the housing.

The power source, e.g., an electrical energy storage/current source element may be arranged completely within the housing, i.e., completely outside of the lighting body. Alternatively, a part of the power source, e.g., an electrical energy storage/current source element may be located in the lighting body. Preferably, the weight portion of the part of the electrical power source, e.g., an electrical energy storage/current source element located in the housing is at least 25%, more preferably at least 50% of the total weight of the power source, e.g., an electrical energy storage/current source element, in order to increase the stability.

Because at least a part of the energy storage is situated at a spatial distance from the lighting body, the weight of the lighting body is reduced accordingly, thereby increasing the stability of the lighting body when attached to a supporting body.

According to a further aspect of the present invention, a set of lighting devices, having a plurality of the above-described lighting devices, is provided. According to an example embodiment, all lighting devices are able to be switched on and off centrally, e.g., by remote control, by a wireless transmitting device, thereby simplifying the operator control. A set, according to an example embodiment of the present invention, may have a separate power source, e.g., an electrical energy storage/current source element assigned to each lighting device, so that wiring between the lighting devices or to a central power source, e.g., an electrical energy storage/current source element may be omitted. The present invention may thus differ from a conventional string of lights for a Christmas tree, which, for example, is typically supplied with energy by a central battery independently of an electrical network.

In each lighting device, switches may be provided for switching the light-emitting elements on and off. In order to simplify the operator control, all the switches are preferably centrally operable along the lines of a remote control with the aid of a wireless transmitting device, e.g., are able to be switched on and off simultaneously.

The power source, e.g., an electrical energy storage/current source element may permit operation of the lighting device over a relatively long period of time, e.g., at least 30 minutes and preferably at least 60 minutes, without additional external energy input. The energy storage may include one or more batteries and/or one or more accumulator storage batteries.

In an example embodiment, one of the lighting devices is preferably designed as a transmitting device, e.g., a suitable transmitter is integrated in one of the lighting devices of the set. In this embodiment, it may be possible to dispense with a separate remote-control transmitting device. Operator control may be simplified, since misplacement of the remote-control transmitting device is ruled out. Thus, there is provided, in an example embodiment of the present invention, a set having a plurality of lighting devices, each lighting device including a switch for switching the light-emitting element on and off, whereby the switches of all the lighting devices are centrally operable using a wireless transmitting device, and wherein the transmitting device is integrated in one of the lighting devices of the set. In this embodiment, expenditure may be reduced and the operator control may be simplified.

In another embodiment, a separate remote-control transmitting device is employed. For example, in an example embodiment of the present invention, there is provided a set having a plurality of lighting devices, each lighting device including a switch for switching the light-emitting element on and off, whereby the switches of all the lighting devices are centrally operable using a wireless transmitting device, wherein the transmitting device is separately disposed from each one of the lighting devices of the set, such as in a separate remote control device. This embodiment may be especially advantageous for sets that are used outdoors, since access to the individual lighting devices may be limited when employed in this manner. Thus, additional convenience to the operator may be provided, since the remote-control transmitting device may eliminate the need for the operator to go outside to turn the light devices on and off.

In another embodiment, each lighting device of the set may have a transmitting device, so that each lighting device may be used for switching the set on and off. In this manner, it is not necessary to search for a specific lighting device having the transmitter. The operator control may thereby be simplified.

According to a further embodiment of the present invention, a holder for a decorative lighting fitting is provided, wherein the connecting element is flexible, preferably plastically flexible. This arrangement permits adaptation of the holder to different spatial conditions, particularly with respect to the arrangement of the weight, as well as an adjustment of the center-of-gravity position. In this embodiment, there is provided a holder for a candle-shaped lighting body, in which the expenditure is reduced and which allows simple, individually adaptable attachment to a supporting body.

BRIEF DESCRIPTION OF THE DRAWINGS

Further advantages of the present invention may be evident with reference to the attached drawing illustrating several exemplary embodiments, in which:

FIG. 7(*b*) shows a schematic representation of a further set having a plurality of lighting devices, according to an example embodiment of the present invention;

DETAILED DESCRIPTION

Figure 1:
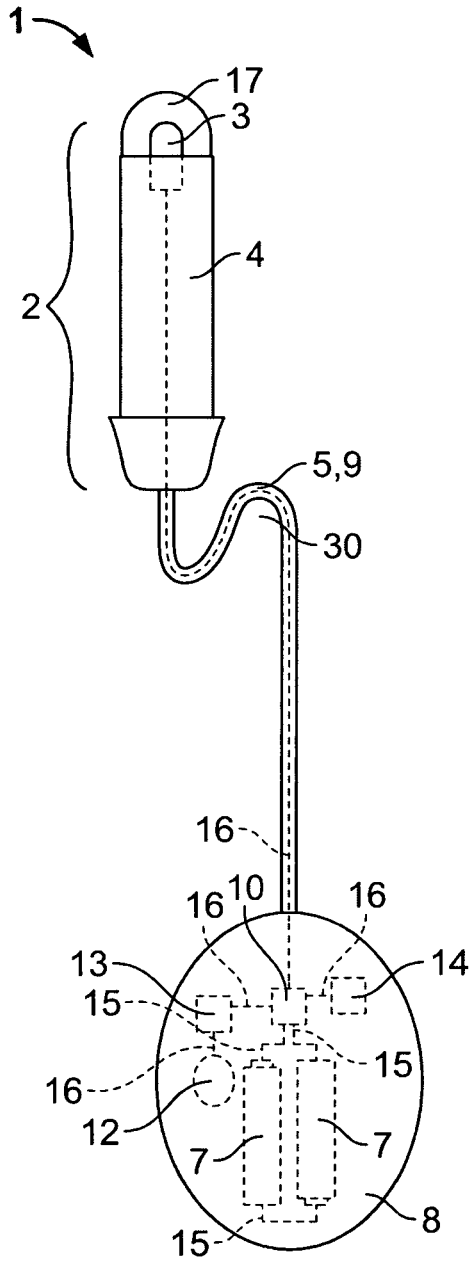
FIG. 1 shows a schematic representation of a first lighting device, according to an example embodiment of the present invention.

FIG. 1 illustrates a lighting device according to an example embodiment of the present invention. An electrical decoration-lighting device 1 includes a lighting body 2, a connecting element 9 and a housing 8. The lighting body 2 includes a light-emitting element 3 and a shaft part 4. The light-emitting element 3 may be an electrical lighting arrangement, e.g. an incandescent lamp or glow lamp, a small tubular fluorescent lamp or a light-emitting diode (LED). Preferably, light-emitting diodes are operated in pulsed fashion, preferably using a suitable frequency, so that the change between bright and dark phases is not perceived by the observer. The maximum operational life may thereby be considerably prolonged.

The lighting device 1 has the connecting element 9 for connecting the lighting body 2 to the housing 8. An electrical line 16 for connecting the light-emitting element 3 to an power source, e.g., an electrical energy storage/current source element 7 is provided within the connecting element 9. The power source, e.g., an electrical energy storage/current source element 7 is preferably formed by one or more dry cells, e.g. button cells, round miniature cells or rechargeable batteries. For example, two round cells may be provided for making a supply voltage of, for instance, 3 V available. Moreover, the power source, e.g., an electrical energy storage/current source element 7 may serve, via the supply lines 16, as the power supply for the transmitter 13 and the receiver 14. For aesthetic purposes, the electrical lines 15, 16 are preferably disposed within the hollow connecting element 9, as well as within the lighting body 2 and the housing 8. In this example embodiment, the power source, e.g., an electrical energy storage/current source element 7 is situated within the housing 8. The power supply is interrupted by a switch 10 which, for example, may be an on-off switch or a multi-step or stepless switching element for setting different levels of brightness of the light-emitting element 3. The housing 8 may be designed as a decorative element.

The connecting element 9, in the specific embodiment of the present invention illustrated in FIG. 1, is rigid and has a loop 30 which is used for hanging on a supporting body, e.g., an essentially oblong supporting body 6 (see, for example, FIG. 3), for instance, the branch of a Christmas tree. In this case, the connecting element 9 functions as the attachment element 5 at the same time. In this way, lighting device 1 is attached to supporting body 6 in a manner allowing lighting device 1 to swivel, such that even given a deflection, because of the low center of gravity, it swivels back again to the desired, e.g., upright, position. Fastening to other supporting bodies, e.g. nails, hooks or bands which are attached to other objects, etc., is also possible.

Figure 6:
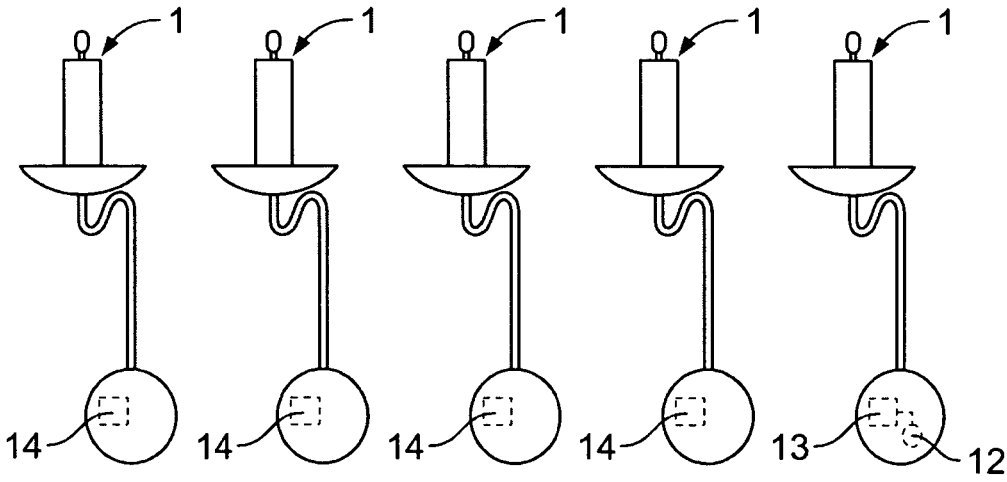
FIG. 6 shows a schematic representation of a set having a plurality of lighting devices, according to an example embodiment of the present invention.
Figure 7A:
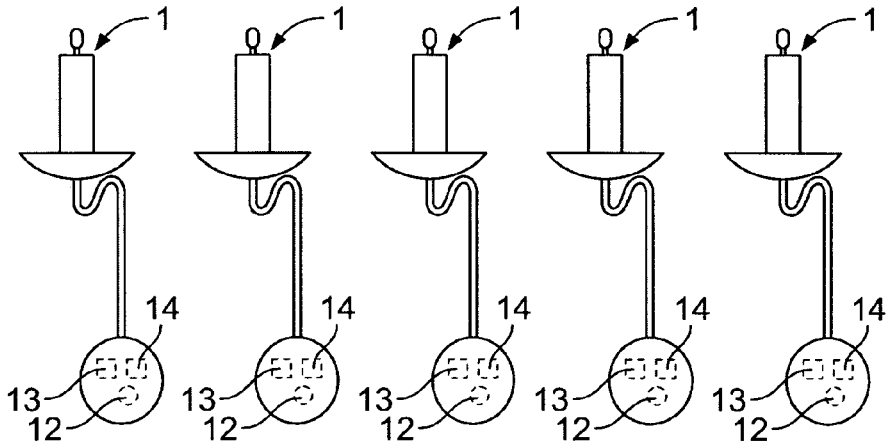
FIG. 7(*a*) shows a schematic representation of a further set having a plurality of lighting devices, according to an example embodiment of the present invention.
Figure 7B:
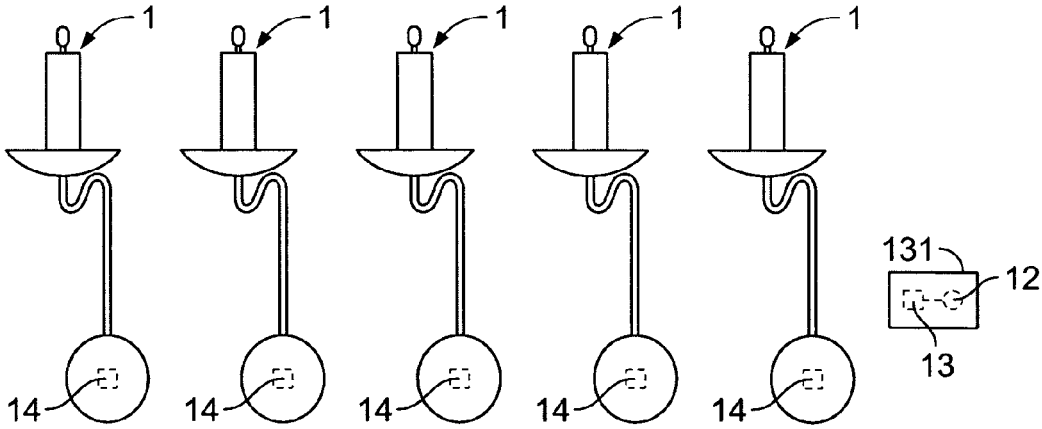

FIGS. 6 and 7(*a*) and (*b*) show, in accordance with various example embodiments of the present invention, a set having a plurality of lighting devices 9, for example, for decorating a Christmas tree. As shown in these examples, to switch all lighting devices 1 of the set on and off simultaneously, at least one lighting device 1 features remote-control means having a wireless transmitter 13 and an actuating element 12 conveniently arranged on the exterior of the housing 8. By operating the actuating element 12, an electromagnetic or acoustical signal is emitted by the transmitter 13. It is preferably a radio signal, for example, in the frequency band around 433 MHz. Any other type of signal, e.g., an infrared signal, an ultrasonic signal, etc., may also be used. For visual reasons, the transmitter 13 is preferably situated in the housing 8 in a manner that it is not visible.

In addition, in various embodiments, each of the remaining lighting devices 1 of the set may have a receiver 14, the receiver 14 being configured for receiving and detecting the signal sent by the transmitter 13. The receiver 14 is connected to the switch 10, and in response to a received signal, switches the switch 10 in order to turn the lighting device 1 on or off or to change the lighting device to a specific operating state.

In the example embodiment illustrated in FIG. 6, one lighting device 1 of the set is designed as a transmitting device having a transmitter 13 and an actuating means 12, while the remaining lighting devices 1 of the set have a receiver 14, but no transmitter 13 (e.g., a master-slave configuration). Advantageously, the lighting device 1 having the transmitter 13 does not have a receiver 14 in this configuration if the switch 10 is operable by the actuating element 12.

In the embodiment illustrated in FIG. 7(*a*), all the lighting devices 1 of the set are constructed in accordance with the transmitter device 13 illustrated in FIG. 1. For instance, each lighting device 1 has a transmitter 13, an actuating means 12 and a receiver 14. This embodiment has the advantage that each lighting device 1 may be used for switching the set on and off, and it is not necessary to search for a specific lighting device 1 designed as a transmitting device.

In the example embodiment illustrated in FIG. 7(*b*), a separate remote control device 131, having the wireless transmitter device 13 and the actuating element 12, is employed as a transmitting device. The lighting devices 1 of the set each have a receiver 14 for receiving a signal from the transmitter device 13. This embodiment has the advantage that, when used, e.g., outdoors or in any location where access to the individual lighting devices may be limited, the need for the operator to have access to the individual lighting devices may be elminated.

Depending on which of the embodiments is employed, one or more of the transmitter 13, the receiver 14, the switch 10 and/or the actuating element 12 are preferably arranged on or in the housing 8 rather than on or in lighting body 2, so as to minimize the weight of the light body 2, thereby increasing the stability of lighting body 2 when attached to supporting body 6.

Figure 2:
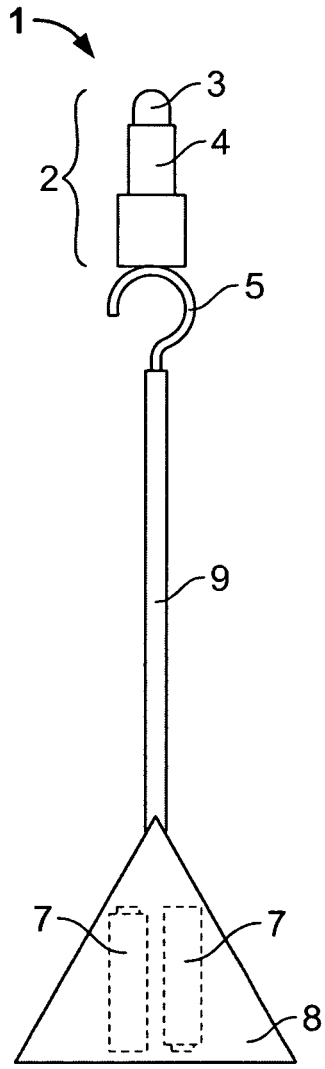
FIG. 2 shows a schematic representation of a lighting device, according to another example embodiment of the present invention.

In the embodiment shown in FIG. 2, an attachment element 5 in the form of a hook is employed, which is used for hanging via the supporting body 6. Compared to the specific embodiment according to FIG. 1, this has the advantage of a centered suspension, thereby facilitating the adjustment of an upright position of the lighting body 2.

Figure 3:
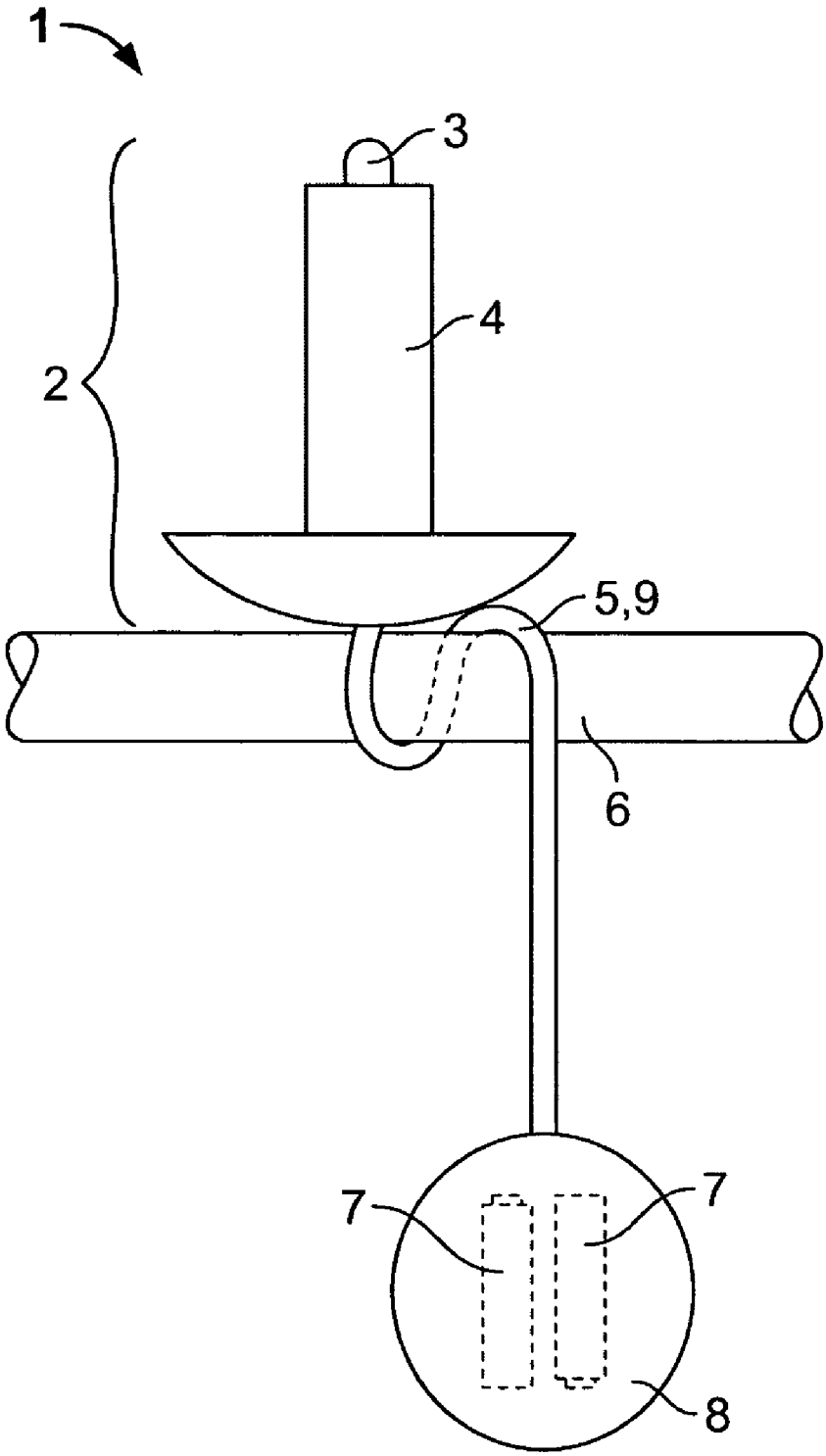
FIG. 3 shows a schematic representation of a lighting device, according to another example embodiment of the present invention.

In the embodiment illustrated in FIG. 3, the attachment element 5 is formed by the connecting element 9. For this purpose, the connecting element 9 may be plastically flexible, and exhibits sufficient rigidity to fasten the lighting body 2 on the supporting body 6 in stable fashion and to retain it in the desired position. To this end, for example, the connecting element 9 is looped once or several times around the supporting body 6. A suitable material for the connecting element 9 or parts thereof is, e.g., a wire.

Figure 4:
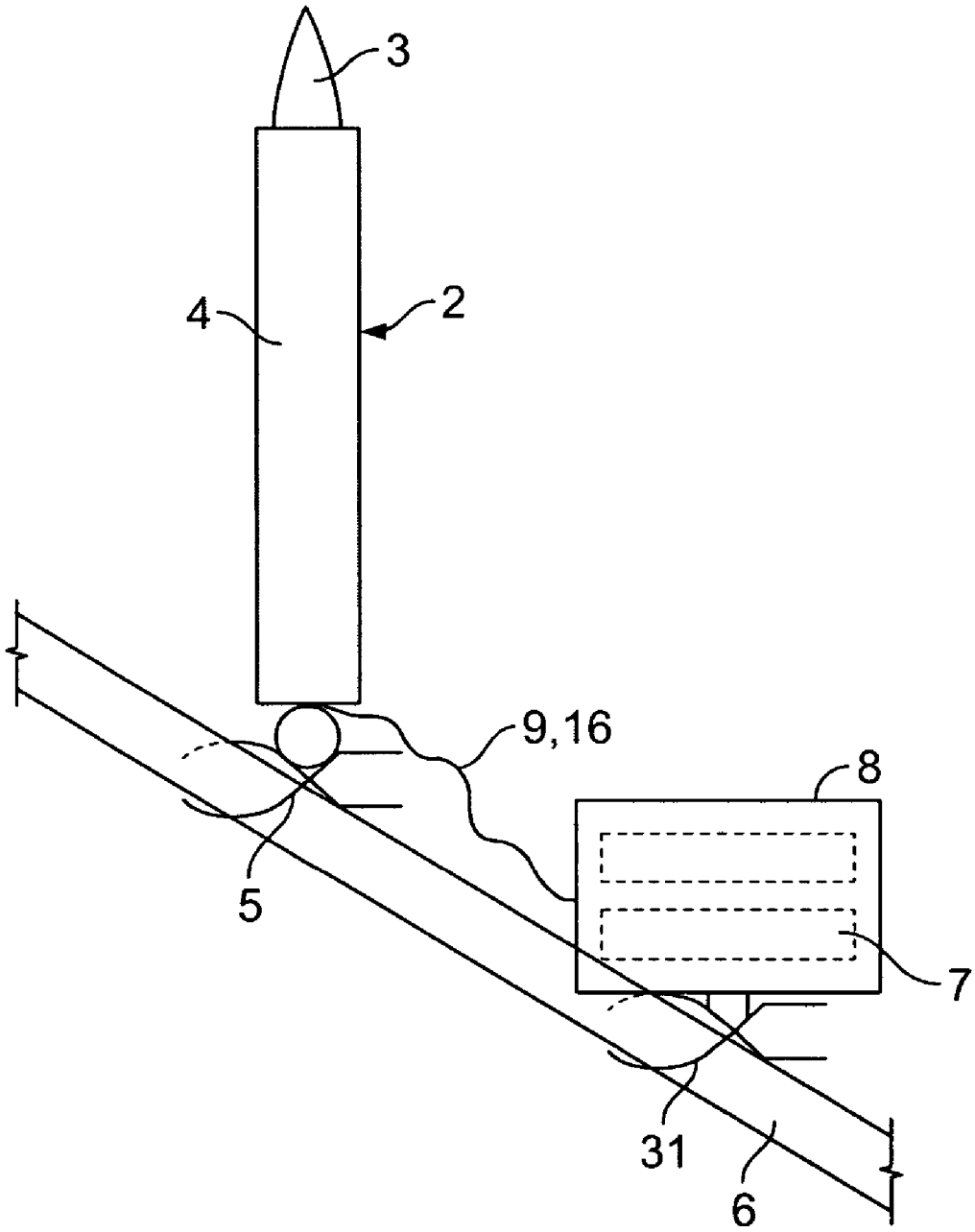
FIG. 4 shows a schematic representation of a lighting device, according to another example embodiment of the present invention.

In the embodiment illustrated in FIG. 4, the lighting body 2 is attached by an attachment element 5 in the form, for instance, of a clip. The connecting element 9 is flexible and may be formed, for example, by electrical supply lines 16 between the lighting body 2 and the housing 8. The housing 8 may have a separate attachment element 31. This embodiment has the advantage that, depending on the spatial conditions, the housing 8 may be placed independently of the lighting body 2 and may be hidden if desired. The connecting element 9 preferably has no rigidity, in order to facilitate the free placement of the housing 8. Separate attachment element 31 for the housing 8 may be eliminated, for instance, if the housing 8 is held in, e.g., an Advent wreath. Also, it should be noted that, while the embodiment illustrated in FIG. 4 shows the supporting body 6 being generally horizontal, in other example embodiments, the attachment element 5 may be a sleeve or the like such that the lighting devices may be employed as a Christmas tree topper, e.g., and the supporting body 6 may be a branch of a Christmas tree.

It should be noted that the switching element 10, the lines 15, 16, the receiver 14 and, optionally, the transmitter 13 and the actuating means 12 are not illustrated in FIGS. 2 through 4 for the sake of simplicity.

Figure 5:
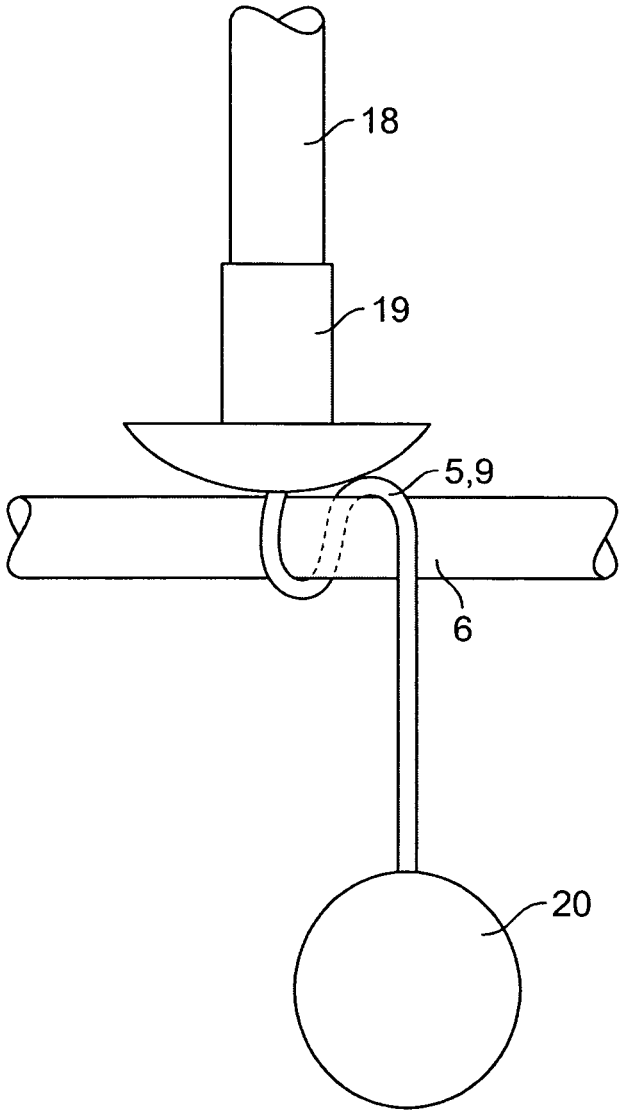
FIG. 5 shows a schematic representation of a holder for a lighting fitting, according to an example embodiment of the present invention.

FIG. 5 shows, according to an example embodiment of the present invention, a holder for a decorative lighting fitting 18, e.g. an electric candle or a wax candle. The holder includes a receiving means 19 for holding a lighting fitting 18, a weight 20 for retaining lighting fitting 18 in a stable position and a connecting element 9 for connecting the receiving means 19 to the weight 20. Similar to the example embodiment shown in FIG. 3, the attachment element 5 is formed by the connecting element 9. The features described hereinabove with respect to FIG. 3 may also be present herein.

The lighting body 2 may be designed so that the visual impression of a traditional wax candle in a candle holder is achieved. For example, red, orange and/or yellow light emitting diodes may be used for this purpose. Ornamental elements, e.g. a candle plate, may be provided which is used with conventional candlesticks for catching dripping candle wax. Such decorative elements are represented by way of example in FIG. 1 or FIG. 3 at the lower end of the shaft part 4 of the lighting body 2. Referring to FIG. 1, at the upper end of the shaft part 4, the lighting body 2 may have a cap 17 for protecting the light-emitting element 3. The cap 17 may be in the form of a flame, for instance, or have additional visual elements such as color filters or lenses. However, the protective cap 17 may be optional.

Furthermore, the shaft part 4 of the lighting body 2 may be optional if, for example, the visual impression of an electric candle or a wax candle is not desired.

Figure 8:
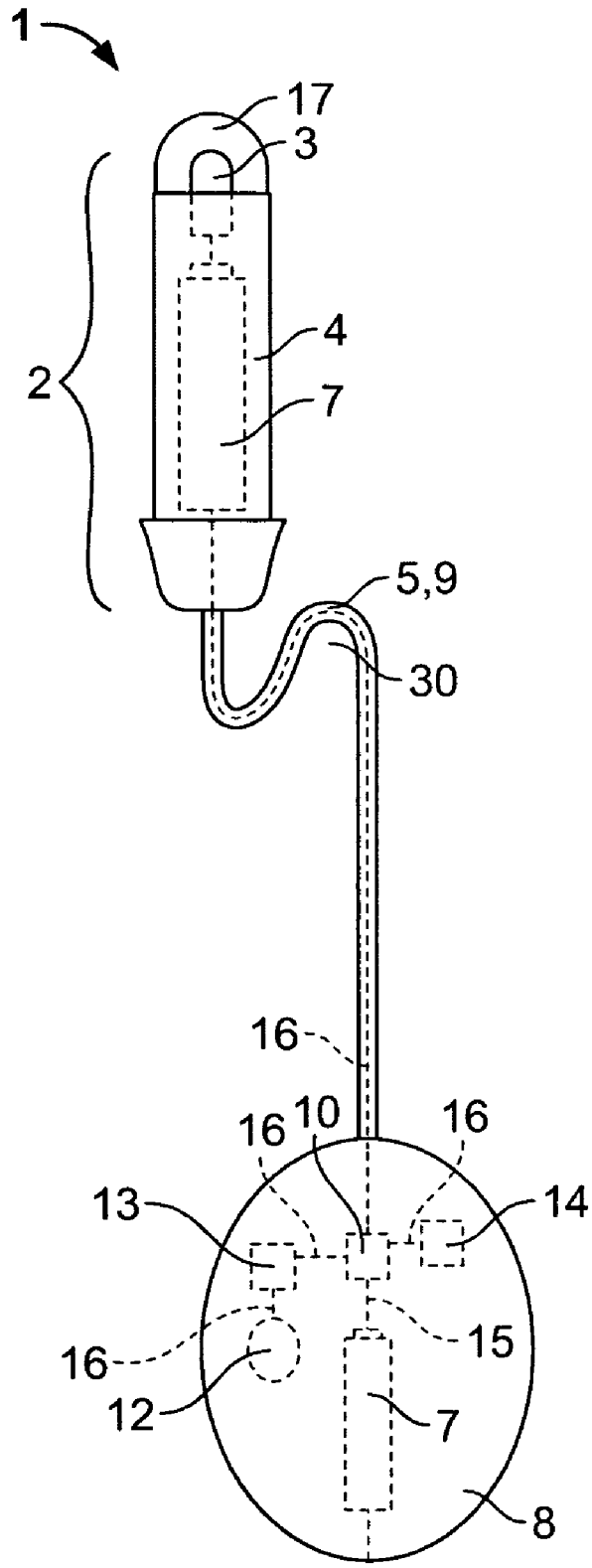
FIG. 8 shows a schematic representation of another lighting device having a power supply disposed partially in the lighting body, according to an example embodiment of the present invention.

In one example embodiment according to FIG. 8, a part of the power supply, e.g., a battery 7, is disposed in lighting body 2, while another part of the power supply, here a further battery 7, is disposed in housing 8. Here, the weight portion of the part of the power supply situated in housing 8 may be approximately 50%.

In addition, as is illustrated in FIG. 8, the housing 8 and/or the connecting element 9 may be used as a ground. Therefore, only one electrical connecting line 16 may be sufficient in connecting element 9.

Figure 9:
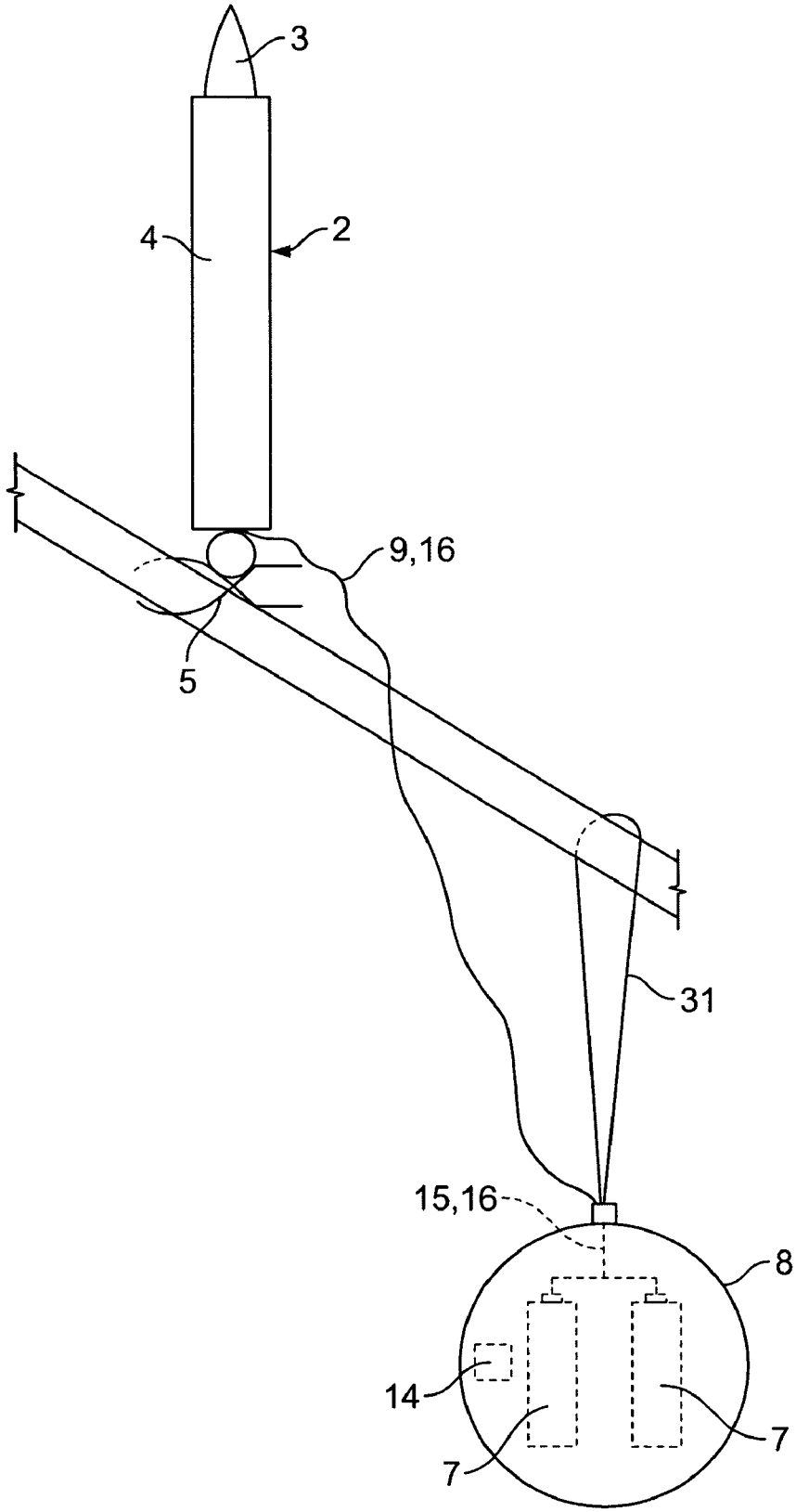
FIG. 9 shows a schematic representation of a lighting device, according to another example embodiment of the present invention.

In the example embodiment according to FIG. 9, the lighting body 2 is attached by an attachment element 5 in the form, for instance, of a clip. The connecting element 9 is flexible and may be formed, for example, by electrical supply lines 16 between the lighting body 2 and the housing 8. The housing 8, shown in the form of a Christmas tree glitter ball, has a separate attachment element 31, illustrated as a customary loop for hanging over a branch of a Christmas tree. This arrangement has the advantage that, depending on the spatial conditions, the housing 8 may be placed independently of lighting body 2, as well as the advantage of relieving lighting body 2 of weight. Connecting element 9 preferably has essentially no rigidity, in order to facilitate the free placement of housing 8. A separate attachment element 31 is optional for housing 8; a freely suspended arrangement of housing 8 is conceivable, as well. For example, a battery 7 may be accommodated in housing 8 and a battery 7 may be accommodated in lighting body 2 in the case of FIG. 8.

Those skilled in the art will appreciate that numerous modifications of the exemplary embodiments described hereinabove may be made without departing from the spirit and scope of the invention. Although various exemplary embodiments of the present invention has been described and disclosed in detail herein, it should be understood that this invention is in no sense limited thereby.

What is claimed is:

1. A set comprising:

a plurality of lighting devices, each lighting device including:

a lighting body having a light-emitting element;

an attachment element for attaching the lighting device to a supporting body at an attachment location; and an independent power source for supplying power to the light-emitting element, the power source at least partially disposed in a decorative housing that is disposed spatially apart from the lighting body and lower than the attachment location for stabilizing the light device when attached at the attachment location; and a wireless transmitting device configured to turn on and off the light-emitting elements of each one of the plurality of lighting devices.

2. The set as recited in claim 1, wherein the wireless transmitting device is integrated in one of the plurality of lighting devices.

3. The set as recited in claim 2, wherein the wireless transmitting device is disposed in a remote control unit that is separate from each one of the plurality of lighting devices.

4. The set as recited in claim 1, wherein each one of the plurality of lighting devices includes a switching element that is actuatable for switching the light-emitting element on and off.

5. The set as recited in claim 4, wherein each one of the plurality of lighting devices has a receiver configured to operate the respective switching element of the each one of the plurality of lighting devices.

6. The set as recited in claim 4, wherein at least one of the plurality of lighting devices has a receiver configured to operate the respective switching element of the at least one of the plurality of lighting devices.

7. The set as recited in claim 1, wherein the housing is a Christmas tree ornament.

8. The set as recited in claim 1, wherein the housing is connected to the lighting body by a connecting element.

9. The set as recited in claim 8, wherein the connecting element includes at least one wire between the housing and the body.

10. The set as recited in claim 1, wherein the housing accommodates the entire power source.

11. The set as recited in claim 1, wherein the housing is suspended below the lighting body so as to maintain the body in a substantially upright position above the attachment location.

12. The set as recited in claim 1, wherein the attachment element is one of a twisted wire and a hook.

13. The set as recited in claim 8, wherein the attachment element is formed by the connecting element.

14. The set as recited in claim 1, wherein the body includes a portion that resembles a candle, and the supporting body is a branch of Christmas tree.

15. The set as recited in claim 1, wherein at least one of the lighting devices is configured as a Christmas tree topper, and the supporting body is a branch of a Christmas tree.

* * * * *